US006161930A

United States Patent [19]

Asano

[11] Patent Number: 6,161,930

[45] Date of Patent: Dec. 19, 2000

[54] METHOD AND APPARATUS FOR PREHEATING A PRINTING MEDIUM IN A HOT MELT INK JET PRINTER

[75] Inventor: Kazuya Asano, Nagoya, Japan

[73] Assignee: Brother Kogyo Kabushiki Kaisha, Nagoya, Japan

[21] Appl. No.: 09/102,378

[22] Filed: Jun. 23, 1998

[30] Foreign Application Priority Data

Jul. 2, 1997 [JP] Japan ..... 9-176916

[51] Int. Cl.[7] ..... B41J 2/01

[52] U.S. Cl. ..... 347/102; 101/488

[58] Field of Search ..... 347/102, 88, 17, 347/101, 185; 101/488

[56] References Cited

U.S. PATENT DOCUMENTS

| | | | |
|---|---|---|---|
| 4,963,884 | 10/1990 | Kiguchi et al. | 347/185 |
| 5,043,741 | 8/1991 | Spehrley, Jr. | 347/88 |
| 5,625,398 | 4/1997 | Milkovits et al. | 347/102 |
| 5,633,668 | 5/1997 | Schwiebert et al. | 347/102 |
| 5,668,584 | 9/1997 | Broder et al. | 347/102 |
| 5,691,756 | 11/1997 | Rise et al. | 347/102 |
| 5,774,155 | 6/1998 | Medin et al. | 347/102 |
| 5,831,655 | 11/1998 | Asawa et al. | 347/102 |

FOREIGN PATENT DOCUMENTS

| | | | |
|---|---|---|---|
| 362288043A | 12/1987 | Japan | 347/102 |
| 405050706A | 3/1993 | Japan | 347/102 |

*Primary Examiner*—Eugene Eickholt
*Attorney, Agent, or Firm*—Oliff & Berridge, PLC

[57] ABSTRACT

Before print is made by letting hot melt ink gush out from the nozzle head, paper is heated rapidly to its required temperature, thus enhancing the ink fixing performance of the print. Relative to paper carrying rollers, a preheat platen with preheater on its back side is located upstream in the carriage passage and a main platen with main heater on its back side is located downstream in the carriage passage. Downstream of the main platen are installed a cooling platen, which is cooled by first and second air intake openings to allow air to pass into the printer, and paper ejecting rollers. The surface temperature of the preheat platen is set higher than that of the main platen so that the temperature required for unprinted paper will be reached rapidly.

17 Claims, 7 Drawing Sheets

METHOD AND APPARATUS FOR PREHEATING A PRINTING MEDIUM IN A HOT MELT INK JET PRINTER

BACKGROUND OF THE INVENTION

1. Field of Invention

The present invention relates to an ink jet printer using hot melt ink. In full detail, it relates to the way in which the printer is constructed to heat a medium onto which images are printed. The invention also relates to a method for preheating a printing medium in a hot melt ink jet printer.

2. Description of Related Art

Conventionally, the recording head used in this type of ink jet printer consisted of a nozzle head with manifold nozzles, an ink melting unit with a heater, and a hopper which holds solid ink pellets. This recording head is mounted on the carriage. When fed, paper is in touch with and supported by the platen provided opposite to the nozzle head. The carriage moves in a direction (of its primary scan) perpendicular to the paper feed direction and by letting hot melt ink liquid gush out from the nozzle head, character or graphic images are printed on the surface of the paper.

In this previous type of ink jet printer, when the hot melt ink liquid adheres to the surface of paper whose temperature is low, the ink immediately solidifies on the surface of the paper. That is, the poor fixing of the ink to the paper causes an event that characters or graphics to be printed are missing, posing a problem that good quality of printed images cannot be assured.

Commonly, the ink jet printer was constructed by installing a heater on the rear side of the platen located opposite to the nozzle head in order to increase the temperature of the paper carried in contact with and supported by the platen. The way in which the printer was constructed allows the temperature of the paper to rise to some level when the hot melt ink adheres to the paper, thus preventing the trouble about the ink fixing to paper.

However, the platen equipped with the heater is positioned to face the nozzle head. This means that paper begins to heat when it comes in contact with the platen. Because there is temperature difference between the paper having arrived at the platen and the heater, the platen must carry the paper at some delayed rate until the paper has heated to the required temperature. Therefore, the printer encountered a problem of low printing speed.

Another problem was that the quality and the properties of paper was affected by the temperature of the platen's heater when set too high to increase the temperature of paper rapidly, leading to the degraded print quality.

The achievement in this invention has been made by the efforts to resolve the problems of the previous ink jet printer.

SUMMARY OF THE INVENTION

An object of the present invention is to provide a hot melt ink jet printer which enables high speed printing to be performed by increasing the temperature of paper efficiently.

First, to accomplish this object, the present invention offers, according to one aspect of this invention, a hot melt ink jet printer constructed to carry a medium onto which images are printed along the surface of a main platen located opposite to a nozzle head gushing out hot melt ink, to carry the medium while heating it from its back side by at least the main platen, and to eject the medium after forming images on its surface by letting hot melt ink gush out from the nozzle head. In this printer, a preheat platen is located upstream of the main platen in the carriage passage in order to preheat the medium carried along the surface of the preheat platen.

Second, according to another aspect of this invention, the hot melt ink jet printer according to one aspect of this invention additionally comprises main heating elements on the back of the main platen and auxiliary heating elements on the back of the preheat platen.

Third, the present invention offers the hot melt ink jet printer according to the first or the second aspect of this invention, wherein each front surface of the preheat platen and main platen is shaped in a convex curve toward the nozzle head.

Fourth, the present invention offers the hot melt ink jet printer according to either the first or the third aspect of this invention, wherein springy pressurizing pieces are located on the surface of the preheat platen and/or main platen so that the medium onto which images are printed is well pressed against the surface of the platen.

Fifth, the present invention offers the hot melt ink jet printer according to either the first or the fourth aspect of this invention, wherein the heating elements are set so the surface temperature of the preheat platen would be approximately equal to or adequately higher than that of the main platen.

In the ink jet printer offered by the present invention, in addition to heating the medium, onto which images are printed, through the main platen, the medium is preheated by the preheat platen provided upstream of the main platen along the paper carrying passage, and therefore the medium can be heated, approximating the required temperature before it arrives at the printing section. This reduces an adverse effect on the quality of the medium as compared with when the medium is heated in a short distance and produces a beneficial effect that higher printing and carrying speeds can be achieved.

Furthermore, the printer can have separate heating elements for the main platen and the preheat platen on their back side, so that the amount of generated heat applied to the medium onto which images are printed can be controlled for each platen separately. This prevents only the portion of the medium opposite to the nozzle head from overheating and is so effective that trouble such as nozzle clogging can be eliminated.

When, in addition, each front surface of the preheat platen and the main platen is shaped in a convex curve toward the nozzle head, the entire back surface of the medium onto which images are printed is carried evenly in contact with the convexedly curved surface of each platen, and therefore the heat conduction from each platen to the medium can be performed more efficiently and the medium can be heated to the required temperature effectively in a shorter distance.

Furthermore, springy pressurizing pieces press the medium onto which images are printed against the surface of each platen, which allows the medium, when carried, to tightly contact the heating portion of each platen and heat conduction from each platen to the medium is carried out more efficiently, producing an effect that the temperature of the medium can be increased to the required temperature during the move of quite a little distance.

If, for example, the surface temperature of the preheat platen is set higher than that of the main platen installed in the position facing the nozzle head, the medium onto which images are printed is heated sufficiently and thus less heat is required for the main platen to heat it further, even though the temperature of the medium is likely to somewhat decrease during the transfer to the main platen. Therefore, the medium can readily be heated to the required temperature efficiently, which produces a good effect that a higher medium carrying speed and eventually a higher printing speed can be achieved. Even if the surface temperatures of both platens are set at nearly the same, a sufficient preheating effect can be produced.

Finally, in application of this invention, even though the distance of the paper carrying passage from the paper feeding section to the paper ejecting section is designed to be shorter, it is quite efficient to heat the medium onto which images are printed during this passage, thus an additional effect is produced that a compact printer assembly can be achieved.

BRIEF DESCRIPTION OF THE DRAWINGS

Preferred embodiments of the present invention will be described in detail with reference to the following figures wherein.

DETAILED DESCRIPTION OF PREFERRED EMBODIMENTS

Figure 1:
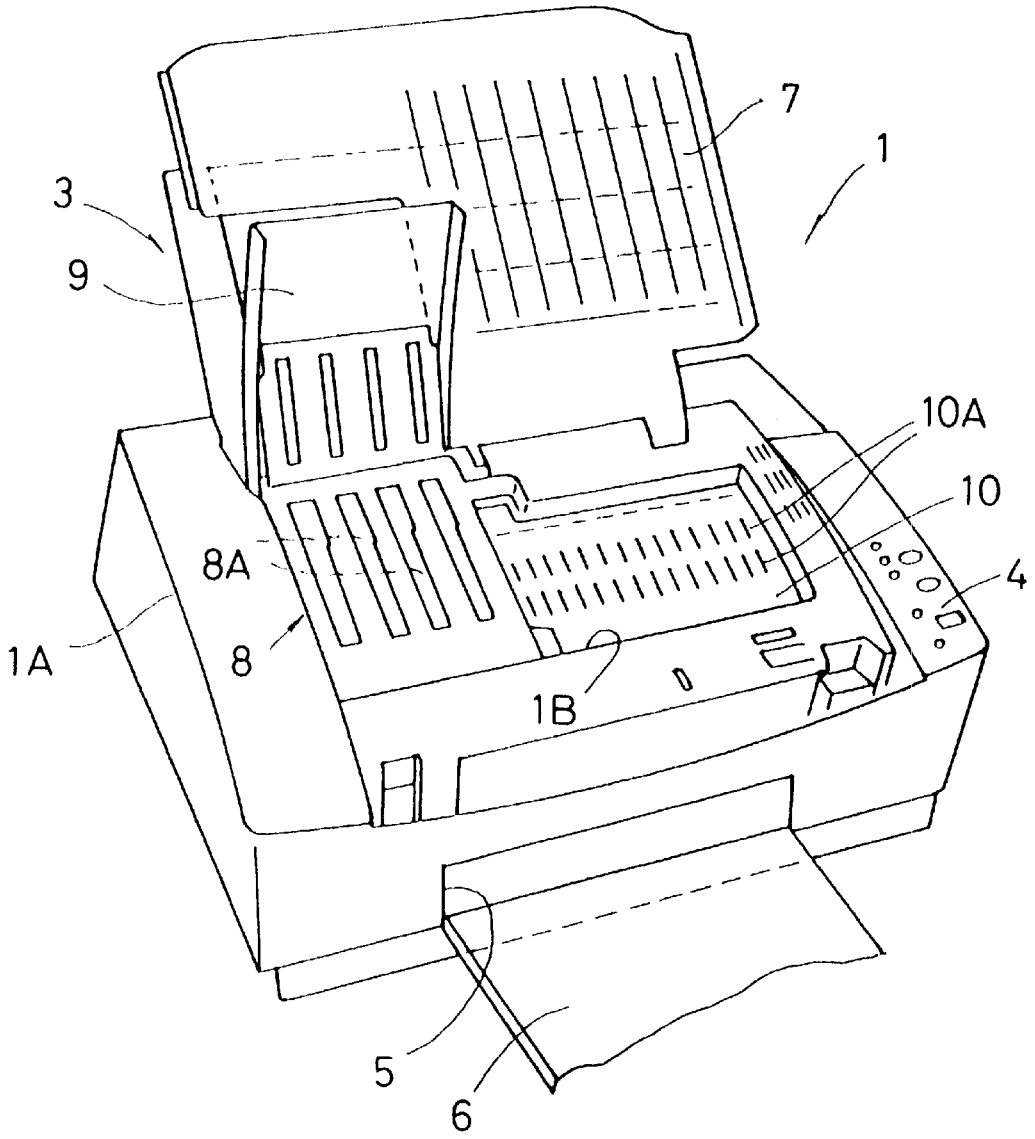
FIG. 1 is a perspective view of the printer according to the present invention.
Figure 2:
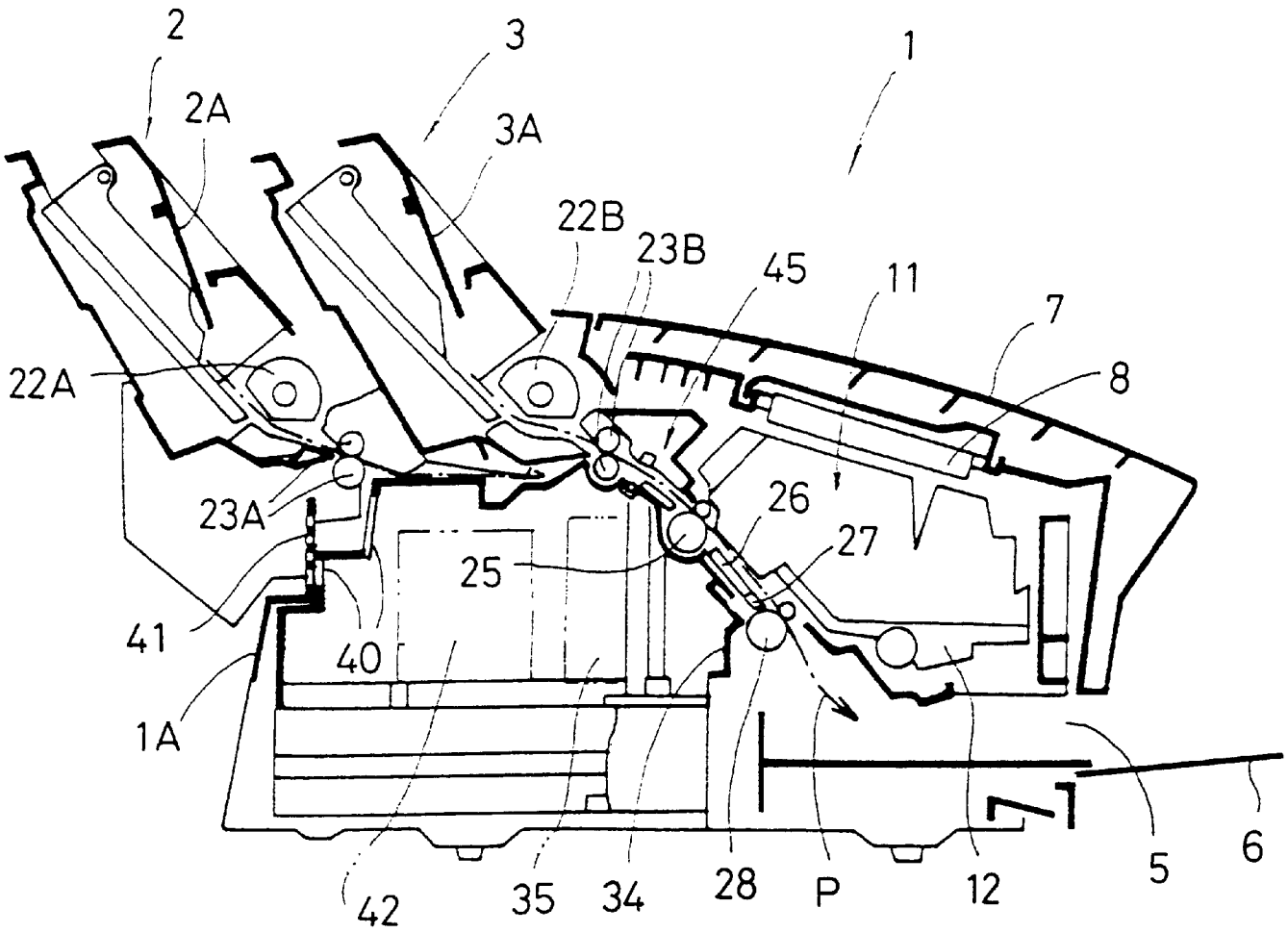
FIG. 2 is a cross section of the printer.
Figure 3:
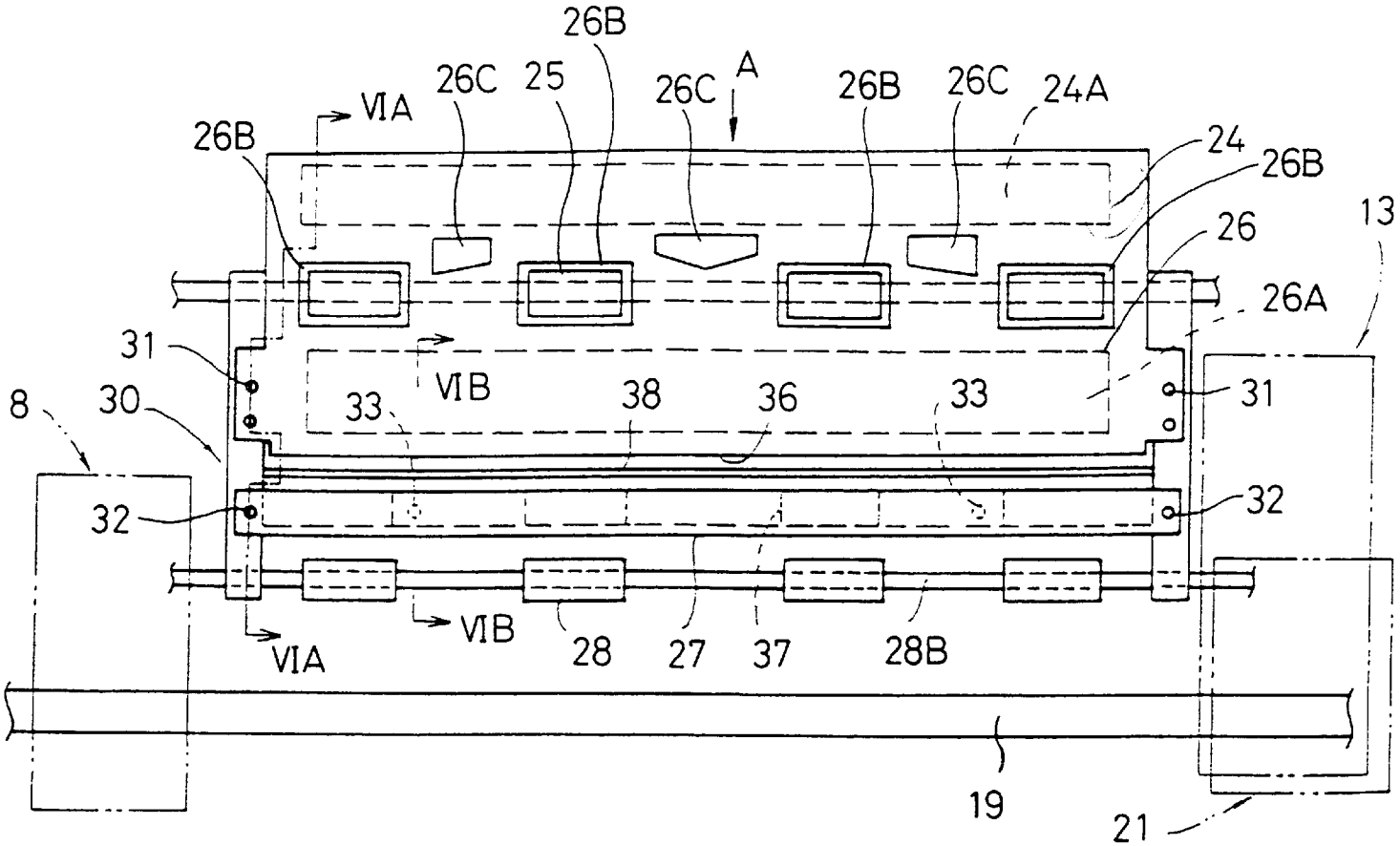
FIG. 3 is a schematic plane view showing the relative positions of carriage, ink supplying section, and maintenance acting section.
Figure 4:
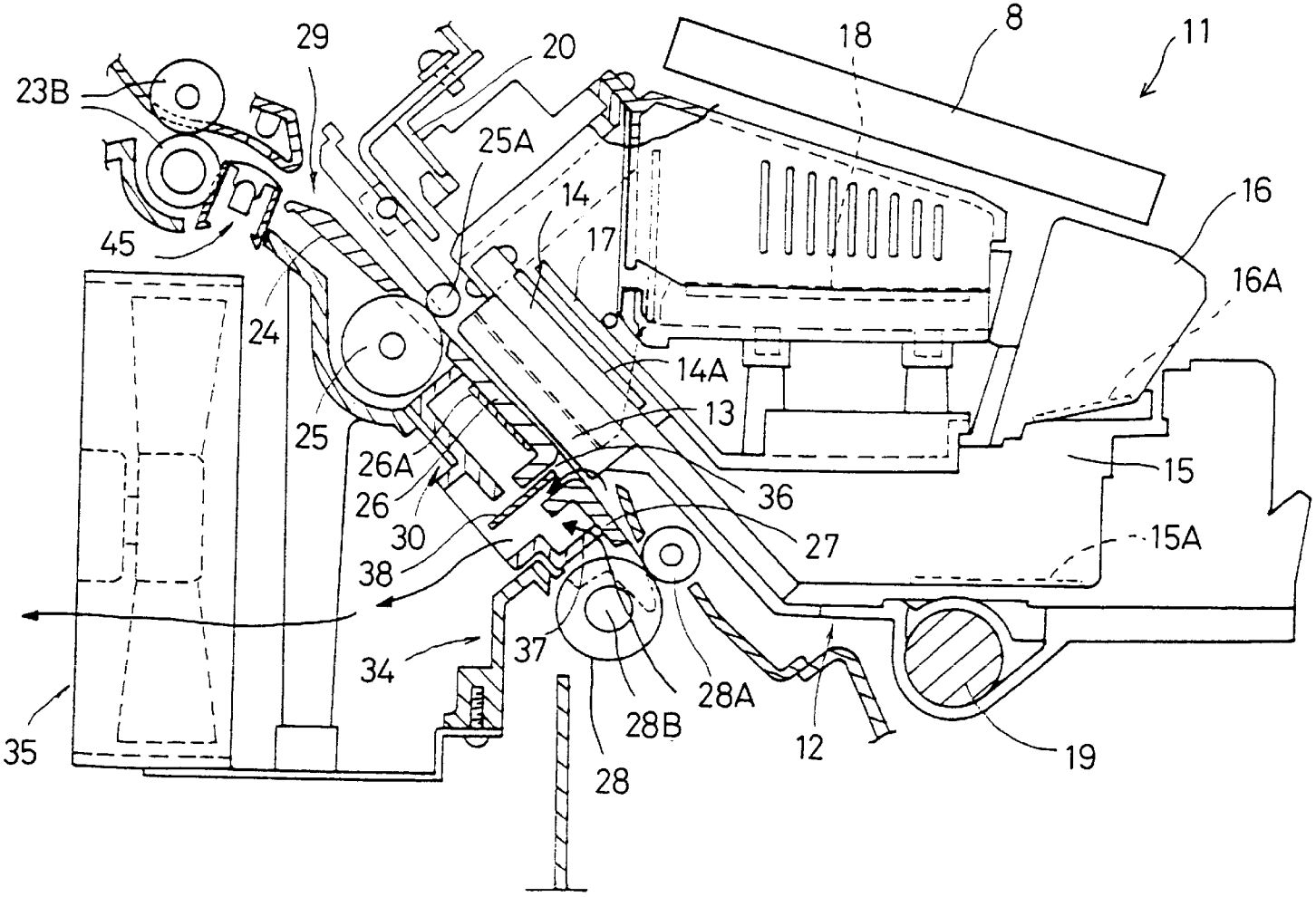
FIG. 4 is a cross section showing an enlarged view of the elements of paper carrying passage.

How the present invention was implemented is described below. FIG. 1 is a perspective view of the hot melt ink jet printer that shows the features of the present invention. FIG. 2 is a cross section of this printer. FIG. 3 is a schematic plane view of the printing section of the printer. FIG. 4 is a cross section showing an enlarged view of the elements of the printer.

As shown in FIG. 1 and FIG. 2, on the top rear of a main frame casing 1A of a printer 1, multiple paper feeder units 2 and 3 are installed, but removable freely, for setting stacked paper sheets, or media onto which images are printed. One paper feeder unit is for cut and plain paper and the other is for transparent sheets such as transparent films for overhead projectors. These media onto which images are printed are referred to as paper hereinafter.

As shown in FIG. 1, a control panel 4 with several switches for operation is provided at right on the top of the main frame casing 1A. In front of the main frame casing 1A, there is a paper ejection opening 5 from which paper P is ejected after printed. The paper P ejected from the paper ejection opening 5 is stacked on a feeder output tray 6.

As shown in FIG. 1, the top surface of a central opening area 1B located on the top of the main frame casing 1A can be covered by an outer cover casing 7 which can be opened and closed freely. On the left of the central opening area 1B, installed is a removable ink case 8 with multiple storage grooves 8A in which yellow (Y), magenta (M), cyan (C), and black (K) ink pellets (not shown) can be stored in rows. The top of the ink case 8 can be exposed by opening its cover casing 9 and the ink case 8 can be removed and reinstalled with the cover casing 9 open. A transparent cover 10 which is fixed to the right edge of the ink case 9 and extends aside can cover over the right portion of the central opening area 1B. Many ventilating holes 10A are provided on the transparent cover 10 to exhaust the air warmed by the heat generated inside the pater.

As shown in FIG. 2 through FIG. 4, a recording head 11 mounted on a carriage 12 includes a nozzle head 13 having many nozzles, which are not shown, to discharge ink, a front panel 14 which supports the nozzle head 13 on its bottom end and is provided with passages through which ink goes and returns and a panel heater 14A for heating these passages on its back surface, an ink tank 15 having a heater 15A on its back surface, a melting hopper 16 with a heater 16A on its back surface, a lid panel 17 which covers over the back surface of the front panel 14, and a relay section 18 which is equipped with printed circuit boards for controlling piezoelectric elements that perform ink jet from the nozzle head 13, printed circuit boards for controlling the heaters 15A and 16A, etc.

The carriage 12 made of heat resistant synthetic resin such as polyether imide, polyamid imide, and polyimide is constructed so that it can be reciprocated by a run mechanism, which is not shown, and in the main scan direction along a guide shaft 19 and guide rails 20.

Below the front end of the ink case 8, an ink supplying mechanism (not shown) is located. If the remaining amount of hot melt ink of a color in the ink tank 15 becomes scarce as the ink is consumed by the execution of printing, the ink must be supplemented. When a sensor, which is not shown, senses that any colored ink is running short, the melting hopper 16 associated with the color of the ink that is running short moves the carriage 12 to position it under the outlet of the associated color ink pellet storage section of the ink case 8. Then, the driving section of the ink supplying mechanism is activated to drop an ink pellet of the required color, which is solid at normal temperature and stored in the ink case 8, into the melting hopper 16. The ink pellet is heated and molted by the heater 16A within the melting hopper 16 and turned into hot melt ink which is supplied to the ink tank 15.

On the other hand, a maintenance acting section 21 is located, outside of the printing area, at the right end of the main frame casing 1A of the printer 1. With the carriage 12 positioned at this maintenance acting section 12 and by using test roll paper and letting hot melt ink gush out from the nozzles to the paper, nozzle clogging and poor operation are prevented to occur during normal print operation.

At the bottom end of the paper feeder units 2 and 3, as shown in FIG. 2, half moon shaped paper feeder rollers 22A and 22B are located and they send the paper P stacked on the paper feeder units 2 and 3 or the manually inserted paper P from manual paper inserting trays 2A and 3A provided on the top of the paper feeder units 2 and 3 to a paper carrying passage 29.

As shown in FIG. 2 and FIG. 4, along the paper carrying passage 29, couples of resist rollers 23A and 23B, a preheat platen 24, paper carrying rollers 25 with their pinch rollers 25A, a main platen 26, a cooling platen 27, paper ejecting rollers 28 with their pinch rollers 28A, the paper ejection opening 5, and the feeder output tray 6 are arranged in this order.

Figure 5:
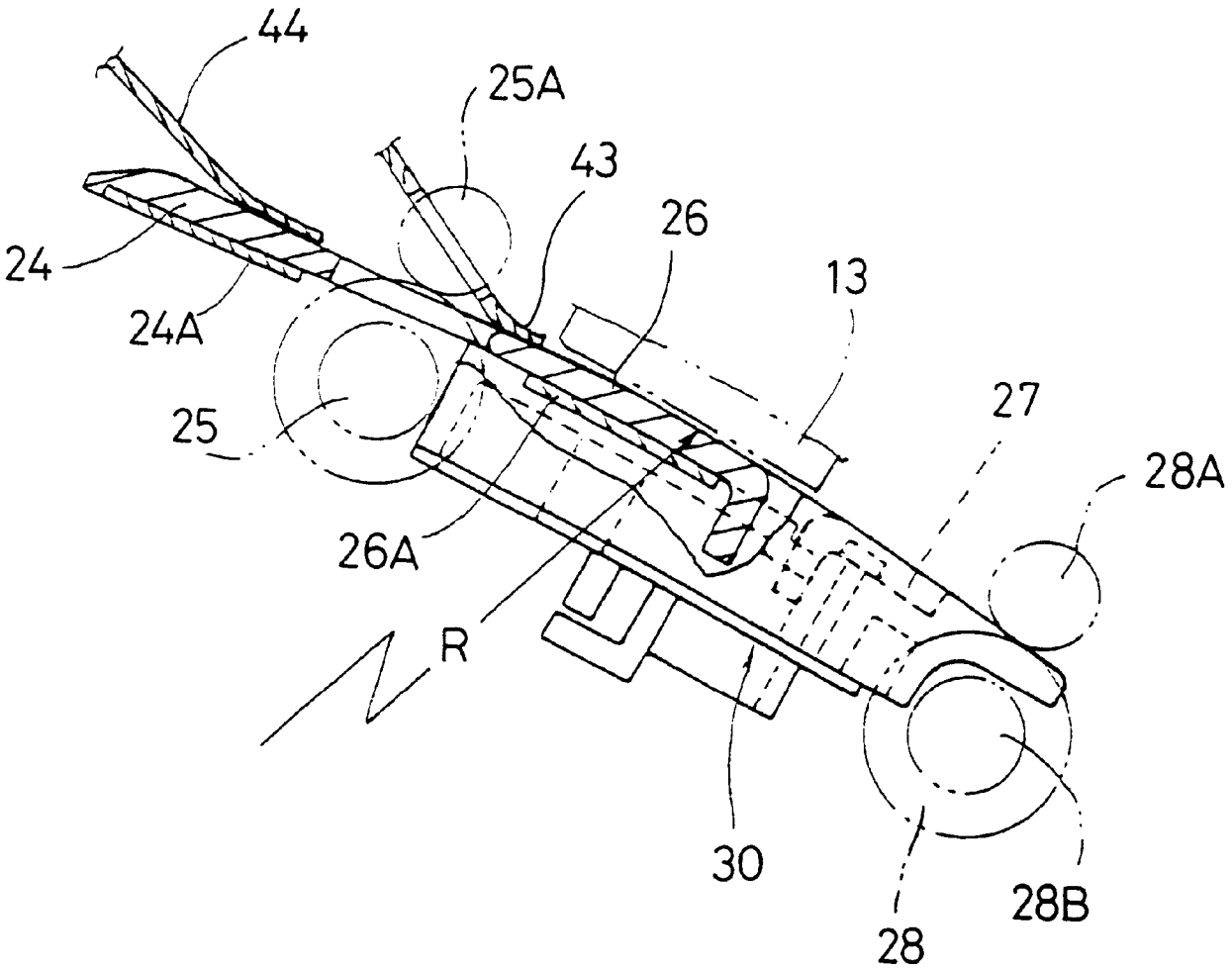
FIG. 5 is a side view showing main platen, cooling platen and their brackets.
Figures 6A, 6B:
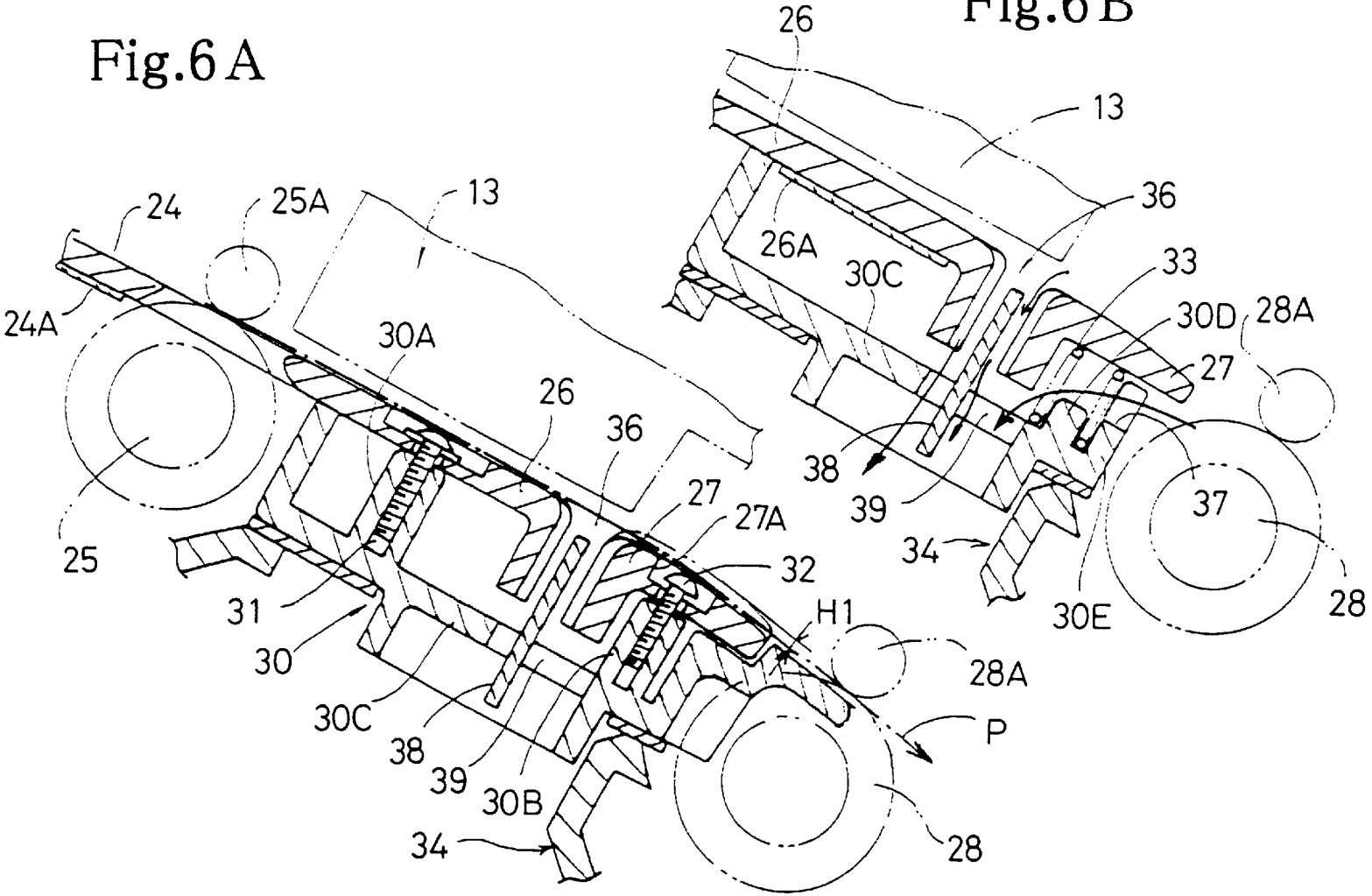
FIG. 6A is a cross-sectional view of FIG. 3 taken along the arrows VIA-to-VIA.
FIG. 6B is a cross-sectional view of FIG. 3 taken along the arrows VIB-to-VIB in FIG. 3.

As shown in FIG. 5 through FIG. 6B, a preheater 24A and a main heater 26A are located in place on the back surfaces of the preheat platen 24 and the main platen 26, respectively. Thus, when the paper P is carried across the preheat platen 24 and the platen 26, its back surface is exposed to the heating by the preheater 24A and the main heater 26A. The cooling platen 27 is provided to cool the printed paper P.

It is desirable to form the preheat platen 24, the main platen 26, and the cooling platen 27 by using highly heat-inductive material such as aluminum. The surface temperature of the preheat platen 24 heated by the preheater 24A should preferably be set higher than that of the main platen 26 heated by the main heater 26. For example, assuming the condition that the paper P is being carried across, that is, contacts with these platens 24 and 26, the surface temperature of the preheat platen should be set at 78° C. and that of the main platen 68° C.

The reason for these temperature settings is as follows. After being increased by the preheat platen 24, the temperature of the paper P somewhat decreases during the transfer to the main platen 26. The quantity of temperature rise expected for the main platen 26 is very small as compared with the previously designed printers of the same type. Thus, the use of these temperature settings may heat the paper P so that the paper temperature can rise to the required temperature across the main platen 26 present in the position opposite to the nozzle head 13 and exposing paper to ink adhesion. This can make the paper P carrying speed and furthermore printing speed faster.

It is desirable to set the surface temperature difference between the preheat platen 24 and the main platen 26 differently according to the thickness and the type of the paper P. In practice, if print is made on thicker paper P with a large specific heat (thermal capacity), e.g., a film for an overheat projector and an envelope, it is recommended to set the surface temperature of the preheat platen 24 at higher. Inversely, if print is made on a thinner paper P with a small specific heat (thermal capacity), e.g., plain paper, it is acceptable to set the surface temperature of the preheat platen 24 nearly equal to that of the main platen 26.

The main platen 26 and the cooling platen 27, as a minimum, have the front surface (facing the back surface of paper P) shaped in a convex curve to form a circumference with a given radius in order to approach the nozzle head 13. The front surface of the preheat platen may be shaped like this.

When paper P is carried across the platens constructed in this way, it is pinched between the paper carrying rollers 25 and their pinch rollers 25A upstream in the carriage passage and the paper ejecting rollers 28 and their pinch rollers 28A downstream, whereby a tensile force is applied to the paper P. At this time, a convexedly curved surface, which is formed throughout the paper carriage path across the preheat platen 25, the main platen 26 and the cooling platen 27, allows the entire back surface of the paper P to be evenly in contact with and supported by the platens. For this reason, the heat conduction to the paper P (heating the paper) by the preheat platen 24 and the main platen 26 and the heat absorption (cooling) by the cooling platen 27 can be performed efficiently.

As shown in FIG. 3, the preheat platen 24 and the main platen 26 are made in an integral plate. Still, to maintain the temperature difference between the preheat platen 24 and the main platen 26, holes 26B are drilled to locate the paper carrying rollers 25. In addition, holes 26C are drilled in multiple places appropriately. Besides, it is desirable to make the thickness of the plate between the preheat platen 24 and the main platen 26 thinner.

The assembly of the main platen 26 and the preheat platen 24 supported by brackets 30, which are made of heat resistant synthetic resin such as polyether imide, polyamid imide, and polyimide, as shown in FIG. 6A, is fixed to projecting sections 30A of the brackets with screws 31 on its both ends. The cooling platen 27 located in the lower section of the brackets 30 is mounted to projecting sections 30B of the brackets on its both ends, in a manner impossible of dropping, with screws 32 that seat within recesses 27A, and as shown in FIG. 6A, it is permitted to move up and down within a very small clearance H (approx. 0.1 mm to 0.2 mm in this example). As shown in FIG. 6B, near the center of the longitudinal direction (the direction of the movement of the carriage 12) of the cooling platen 27, coil springs 33 are inserted between the back surface of the cooling platen 27 and projections 30D which protrude from a base plate 30C of each bracket 30. This spring boosts the cooling platen 27 to protrude toward the nozzle head 13.

Therefore, when paper P is carried and a tensile force is applied to it while pinched between the paper carrying rollers 25 and their pinch rollers 25A upstream in the carriage passage and the paper ejecting rollers 28 and their pinch rollers 28A downstream, the entire surface of the cooling platen can be pressed tightly against the back surface of the paper P along the paper carrying direction. Consequently, the heat conduction from the paper P to the cooling platen 27 is performed efficiently.

The revolving speed of the paper ejecting rollers 28 is set faster than that of the paper carrying rollers 25. In addition, the pinching force produced by the paper ejecting rollers 28 and their pinch rollers 28A is set weaker than that produced by the paper carrying rollers 25 and their pinch rollers 25A. These settings enable paper to slip faster on the paper ejecting rollers 28 by the difference between the revolving speeds of the paper ejecting rollers 28 and the paper carrying rollers 25. Even though a weaker pinching force is set for the paper ejecting rollers 28, of course, the paper ejecting rollers 28 and their pinch rollers 28A provide a pinching force enough to inhibit the paper P from flying from the paper carrying passage 29 by the boosting force of the cooling platen 27, which is produced by an elastic force of the coil spring 33.

As shown in FIG. 5, a main buckle 43 and a pre-buckle 44 are provided on the surface of the main platen 26 and the preheat platen 24 respectively as springy pressurizing pieces to press free ends against the platens. The main buckle 43 and the pre-buckle 44 press more positively paper P against the main platen 26 and the preheat platen 24. The buckles 43 and 44 are made of heat resistant synthetic resin material with heat resistance and elasticity, such as polyimide films, or thin metal sheet material with some rigidity, such as stainless sheets and bronze sheets. It is desirable to locate the buckles 43 and 44 to be pressed against both the preheat platen 24 and the main platen 26 respectively, though only one buckle may be assembled to be pressed against either platen.

Downstream of the main platen 26 in the carriage passage, air intake openings and the cooling platen 27 are installed. By a suction fan 35 located on the back side of both platens 26 and 27, the cooling air is introduced from the paper ejection opening 5 and travels toward the cooling platen 27. As shown in FIG. 2, FIG. 4, FIG. 6A and FIG. 6B, the suction fan 35 is located in a frame 34 positioned under the paper carrying passage 29. The above-mentioned brackets 30 are installed in the upper front of the frame 34. By providing a given spacing between the end of the main platen 26 fixed to the brackets 30, toward downstream in the carriage passage, and the end of the cooling platen 27, toward upstream, a first air intake opening 36 is formed longitudinally along the direction of the movement of the carriage 12 as one of the air intake openings. In this first air intake opening 36, a long and narrow heat insulating diaphragm 38 made of heat resistant synthetic resin is located, designed to provide adiabatic isolation between the end of the main platen 26 toward downstream and the end of the cooling platen 27 toward upstream. It is desirable to assemble this heat insulating diaphragm 38 integral with the brackets 30 from the point of view of reducing the number of parts.

On the other hand, between the bottom of the end of the cooling platen 27 toward downstream in the carriage passage and a diaphragm 30E of the brackets 30, multiple second air intake openings 37 are formed, spaced appropriately along the direction of the movement of the carriage 12. These multiple second air intake openings 37 are arranged between the paper ejecting rollers 28 located at proper intervals.

On a base plate 30C of each bracket 30, as shown in FIG. 6A and FIG. 6B, an air passage 39 is drilled which links to the first air intake opening 36 and the second air intake openings 37 and introduces the air to the suction fan 35. Furthermore, as shown in FIG. 2, exhaust openings 40, 41 are provided on the back surface of the frame 34. Inside the frame 34, a printed circuit board for power supply 42 is located between the exhaust openings 40, 41 and the suction fan 35.

In the paper carrying passage 29 between the couple of resist rollers 23B and the preheat platen 24, a light penetration type optical sensor 45 is located to distinguish the type of paper P. The optical sensor 45 senses the quantity of the light that penetrates through the paper P, whereby it determines whether the type of the paper P is plain paper or a transparent film for an overhead projector. After distinguishing the type of paper P, the optical sensor 45 outputs a sense signal which is used for control such as changing the heater temperature condition, mentioned above.

Figure 7:
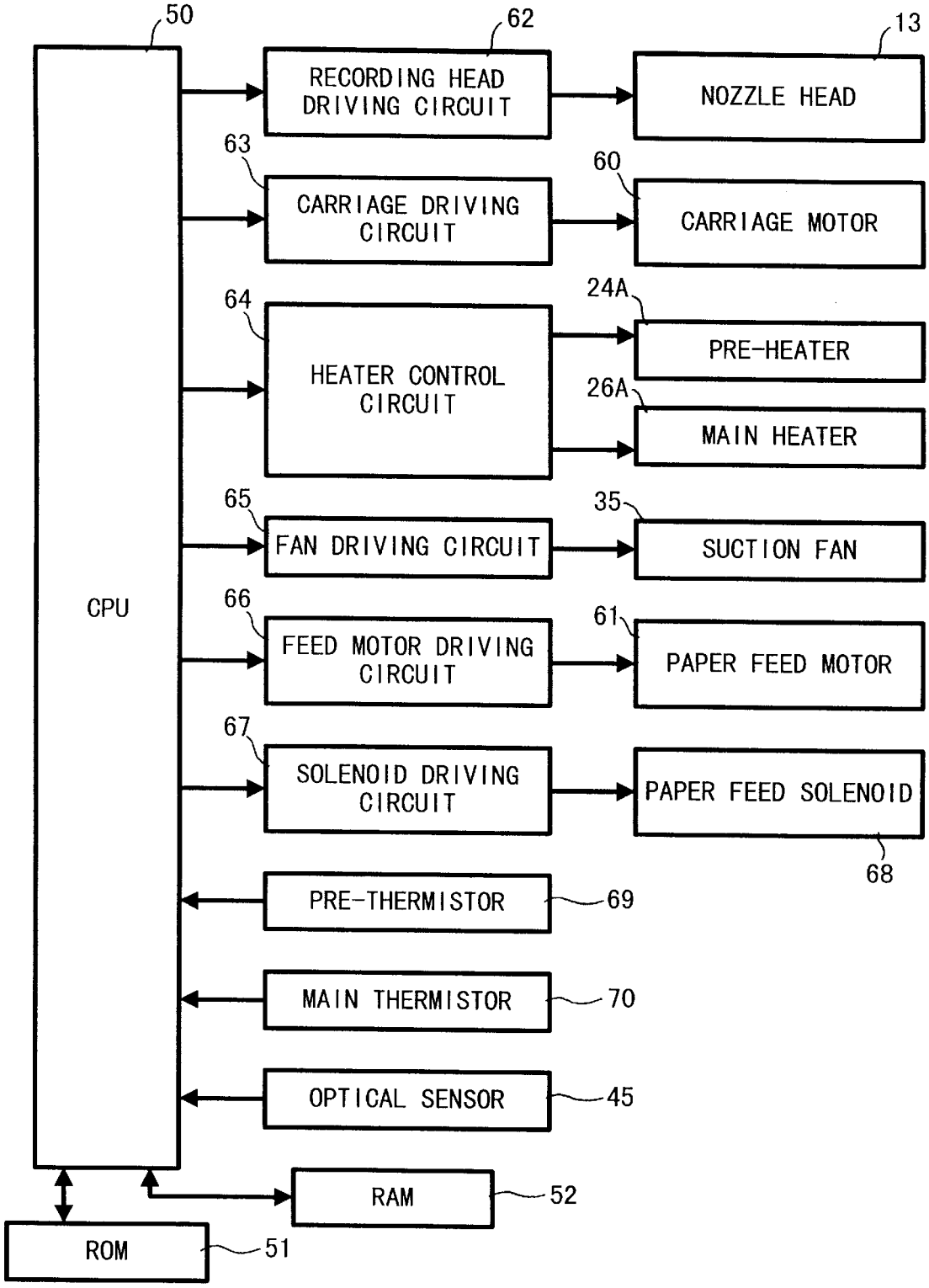
FIG. 7 is a block diagram of the control system.

The control system in the hot melt ink jet printer constructed as above will be described with reference to the block diagram shown in FIG. 7.

According to various control programs previously stored in a ROM 51, a CPU 50 executes various computing and control operations required for printing color images, based on the print data sent from a host computer. The following circuits are connected to the CPU 50: a recording head driving circuit 62, a carriage driving circuit 63, a heater control circuit 64, a fan driving circuit 65, a feed motor driving circuit 66, and a solenoid driving circuit 67. The recording head driving circuit 62 drives piezoelectric elements, which are not shown, based on the print data, causing the ink to gush out from the nozzles installed in the nozzle head. The carriage driving circuit 63 drives a carriage motor 60 which reciprocates the carriage 12 in the main scan direction. The heater control circuit 64 controls energizing the preheater 24A and the main heater 26A. The fan driving circuit 65 drives the suction fan 35. The feed motor driving circuit 66 rotates the paper carrying rollers 25 and paper ejecting rollers 28 in the paper carrying direction, and when in its reverse rotation, drives a paper feed motor 61 to activate either the ink supplying mechanism or the maintenance mechanism as selected. The solenoid driving circuit 67 drives a paper feed solenoid 68 which activates either the paper feeder roller 22A or 22B as selected to send the paper P to the paper carrying passage 29.

Furthermore, the following are connected to the CPU 50: a pre-thermistor 69 to sense the temperature of the preheat platen 24, a main thermistor 70 to sense the temperature of the main platen 26, and the optical sensor 45. Based on the input of a sense signal from any of these sensors, the CPU 50 outputs a given control signal to the heater control circuit 64 or the fan driving circuit 65.

In the ROM 51, in addition to various control programs stored, control temperatures of the preheat platen 24 and the main platen 26 are set and stored according to the type of paper P and the print resolution. A RAM 52 is used as a temporary work area to store the print data sent from the host computer temporarily and for executing control operation.

Next, the action for heating and cooling the paper P is described.

When the power switch, which is not shown, of the printer 1 is turned ON, the printer is put into the print operation standby state, the current begins to flow across the preheater 24A and the main heater 26A and makes them ready for heating, and the suction fan rotates. Because the first air intake opening 36 is not blocked by paper P during the print operation standby state, the air flow from the paper ejection opening 5 goes through the paper ejection end of the paper carrying passage 29 to downstream of the cooling platen 27 and enters the brackets 30 from both the first air intake opening 36 and the second air intake openings 37. The air flows through the suction fan 35 in the frame 34 and along the surface of the printed circuit board for power supply 42, taking away some of the accumulated heat, and is exhausted outside the main frame casing 1A through the exhaust openings 40 and 41. Because it is not necessary to keep the temperature of the preheat platen 24 and the main platen 26 during the print operation standby state, the power supply to the preheater 24A and the main heater 26A remains low, minimizing the power consumption. Accordingly, in addition, the temperature inside the printer 1 does not rise much, so that the revolving speed of the suction fan 35 can be set lower than during the print operation, which makes the power consumption even lower.

Then, when the print operation state is entered, the required power is supplied to the preheater 24A and the main heater 26A to set and keep the preheat platen 24 and the main platen 26 at the required temperature(s). Upon the request for feeding the paper P, the paper feeder roller 22A or 22B is driven to rotate, and the paper P on which images are to be printed, after stopped with its forward end put on the resist rollers 23A or 23B and aligned to be oriented in its carrying direction, is moved toward the paper carrying rollers 25.

The paper P is pressed against the surface of the preheat platen 24 by the prebuckle 44 and subjected to preheating action. Then, it is pressed against the surface of the main platen 26 by the main buckle 43 and subjected to full heating action. Thus, the paper P is adequately heated to the required temperature when in the position facing the nozzle heat 13 and good hot melt ink fixing performance is achieved, even if carried at a high speed.

When the forward portion of the paper P has closed the first air intake opening 36, the suction force by the suction fan 35 prevents the back surface of the paper P from flying from the convexedly curved surface of the main platen 26, and therefore the paper P can also be heated positively by the main platen 26.

Because, in this way, the paper P is carried, in contact with and supported by the surfaces of both platens 24 and 26 and heated to the required temperature, hot melt ink will easily adhere to the paper P when jetted from the nozzle head 13 in the position opposite to the main platen 26.

Then, when the paper P is pinched between the paper ejecting rollers 28 and their pinch rollers 28A, the first air intake opening 36 is closed by the paper P and little air flows in from this opening. As a result, most of the air flow is imported from the second air intake openings 37 located on the back side of the cooling platen 27 and the temperature of the cooling platen 27 decreases rapidly.

As shown in FIG. 6B, the printed portion of the paper P held by the pinch of both the paper carrying rollers 25 and the paper ejecting rollers 28 with their pinch rollers comes in contact with the convexedly curved surface of the cooling platen 27 boosted and protruded by the coil spring 33. Thus, the back surface of the paper P tightly touches the surface of the cooling platen 27, making efficient heat conduction possible from the paper P to the cooling platen 27. Furthermore, because the paper carrying passage 29 (including the preheat platen 24, the main platen 26, and the cooling platen 27) forms a smooth convex curve, the paper P can be carried stably, closely touching the surfaces of these platens, free of an event of paper flying. Consequently, rapid carriage of paper P can be achieved, resulting in high speed printing.

As mentioned above, as the temperature of the cooling platen 27 decreases rapidly, the heat of the paper P can be removed readily while in contact with the surface of the platen before paper ejection. Thus, after print is made on the paper P by letting hot melt ink gush out from the nozzle head 13, during a short distance of carriage until the paper P comes to the position of the pinch between the paper ejecting rollers 28 and their pinch rollers 28, the hot melt ink solidifies on the paper P. At this time, the cooling effect by the cooling platen 27 assures the solidification of the hot melt ink adhered to the paper P, even if the paper P carrying speed is increased by increasing the printing speed. Consequently, the ink does not transfer to the surface of the pinch rollers 28A when the paper P is pinched between the paper ejecting rollers 28 and their pinch rollers 28A and therefore the deterioration of the printed image quality does not occur.

Furthermore, because the heat insulating diaphragm 38 is located in the first air intake opening 36, the heat conduction from the main platen 26 and the cooling platen 27 can be interrupted and it can be assured that the temperature of the cooling platen 27 keeps low.

In this example, when print is made on plain paper, the surface temperature of the main platen 26 is set at 68° C. for a resolution of 300 dpi and 65° C. for a resolution of 600 dpi. When print is made on transparent films for overhead projectors, its surface temperature is set at 80° C. for a resolution of 600 dpi. In this way, if the type of paper P and print condition are changed, the temperature of the main platen 26 during print can be changed readily.

If, for example, some condition change is made, particularly, intending to decrease the temperature of the main platen 26 rapidly, it is necessary to augment the cooling effect on the platen 26 by the air imported from the first air intake opening 36. To accomplish this, with the first air intake opening 36 not blocked by paper P, by increasing the revolving speed of the suction fan 35, faster air flow due to the suction occurs in the narrow passage between the side edges of the carriage passage, downstream of the main platen 26, and the heat insulating diaphragm 38, which can produce more cooling effect on the main platen 26. Together, by making the shape of the clearance between the main platen 26 and the heat insulating diaphragm 38 narrower near the suction inlet and wider inside the brackets 30, the cooling effect can be enhanced all the more.

In the preferred embodiment described above, preheating is performed by bringing the preheat platen 24 in contact with the back surface of paper P in the same way as done with the main platen 26. However, doing so is not always required; e.g., it is acceptable to bring the preheat platen in contact with the front surface of paper P (to which ink adheres). Alternatively, at least two preheat platens may be installed to contact both front and back surfaces of paper P. If, in particular, a concave curve shaped preheat platen is installed to contact the front surface of paper P, the surface of the paper P to which ink adheres can be heated efficiently.

Besides, the preheat platen 24 does not necessarily have a length equal to or more than the main scanning length for paper P. If, for example, the material of the paper P has adequate heat conductivity, sufficient preheating effect can be produced, even if the preheat platen is somewhat shorter than the main scanning length or multiple preheat platens are installed at intervals in the main scan direction.

What is claimed is:

1. A hot melt ink jet printer for printing images on a medium, comprising:

a nozzle head that ejects hot melt ink onto the medium;

a main platen that transports the medium along a carriage passage past the nozzle head, the main platen heating the medium as the medium is transported past the nozzle head; and a preheat platen located upstream of said main platen in the carriage passage to preheat the medium, wherein a surface temperature of said preheat platen is approximately equal to or higher than that of the main platen.

2. The hot melt ink jet printer according to claim 1, wherein a main heater is provided to said main platen and auxiliary heater is provided to said preheat platen.

3. The hot melt ink jet printer according to claim 2, wherein a front surface of each of said preheat platen and said main platen is shaped in a convex curve toward the nozzle head.

4. The hot melt ink jet printer according to claim 3, further comprising at least one springy pressurizing piece located to contact at least one of said preheat platen and said main platen so that the medium is firmly pressed against the main platen.

5. The hot melt ink jet printer according to claim 1, wherein a front surface of each of said preheat platen and said main platen is shaped in a convex curve toward the nozzle head.

6. The hot melt ink jet printer according to claim 1, further comprising at least one springy pressurizing piece located to contact at least one of said preheat platen and said main platen so that the medium is firmly pressed against the main platen.

7. A method for operating a hot melt ink jet printer for printing images on a medium, comprising:

transporting the medium past an ink ejecting nozzle head;

preheating the medium upstream of the nozzle head to a first temperature; and heating the medium as the medium is transported past the nozzle head to a second temperature, wherein the first temperature is approximately equal to or higher than the second temperature.

8. A hot melt ink jet printer for printing images on a medium, comprising:

means for transporting the medium past an ink ejecting nozzle head;

means for preheating the medium upstream of the nozzle head; and means for heating the medium as the medium is transported past the nozzle head, wherein the preheating means is set at a temperature which is greater than that of the heating means.

9. The hot melt ink jet printer according to claim 8, wherein the heating means comprises a main heater associated with a main platen, and the printer further comprises a cooling platen located downstream from the main platen.

10. The hot melt ink jet printer according to claim 9, wherein a gap is provided between the cooling platen and the main platen.

11. The hot melt ink jet printer according to claim 10, wherein the gap comprises a first air intake opening, and the printer further comprises a fan that draws air in the first air intake opening when the medium does not overlie the gap, the fan sucking the medium against the main platen when the medium overlies the first air intake opening.

12. The hot melt ink jet printer according to claim 11, further comprising a second air intake opening disposed below the cooling platen that draws heat away from the cooling platen when the medium overlies the first air intake opening.

13. The hot melt ink jet printer according to claim 10, further comprising a heat insulating diaphragm disposed within the gap.

14. The hot melt ink jet printer according to claim 9, further comprising:

means for tensioning the medium as it is transported past the nozzle head; and means for urging the cooling platen towards the nozzle head to maintain a predetermined contact force between at least the cooling platen and the medium as the medium is tensioned.

15. The hot melt ink jet printer according to claim 8, further comprising:

means for sensing a thickness or type of the medium; and means for adjusting a temperature of at least one of the heating means and the preheating means based on the sensed thickness or type of the medium.

16. The hot melt ink jet printer according to claim 8, wherein each of the heating means and the preheating means includes a front surface having a convex shape curved toward the nozzle head.

17. The hot melt ink jet printer according to claim 8, further comprising means for independently setting temperatures of the heating means and the preheating means.

* * * * *